United States Patent [19]

Montet

[11] Patent Number: 4,528,914

[45] Date of Patent: Jul. 16, 1985

[54] DISPLAY STAND WITH SHELVES

[75] Inventor: Nicole Montet, Suresnes, France

[73] Assignee: Etalagire, Chavenay, France

[21] Appl. No.: 308,870

[22] Filed: Oct. 5, 1981

[30] Foreign Application Priority Data

Oct. 7, 1980 [FR] France ..... 80 21437
Aug. 3, 1981 [FR] France ..... 81 15057

[51] Int. Cl.[3] ..... A47B 57/20

[52] U.S. Cl. ..... 108/60; 211/169; 248/245; 248/297.2

[58] Field of Search ..... 211/131, 169, 144, 129, 211/107, 166; 248/297.2, 218.4; 403/373; 108/60, 95, 96, 107-110

[56] References Cited

U.S. PATENT DOCUMENTS

| | | | |
|---|---|---|---|
| 676,901 | 6/1901 | Luft et al. | 211/107 X |
| 692,858 | 2/1902 | Kade | 248/245 |
| 1,041,264 | 10/1912 | Freud | 248/297.2 X |
| 2,194,238 | 3/1940 | Weaver | 211/169 X |
| 2,247,436 | 7/1941 | Erickson | 248/245 |
| 2,327,742 | 8/1943 | Rosenberg | 211/131 |
| 2,719,692 | 10/1955 | Gredell | 248/245 |
| 3,462,110 | 8/1969 | Cheslock | 248/245 |
| 3,478,893 | 11/1969 | Crosslen | 211/169 X |
| 3,538,863 | 11/1970 | Howard et al. | 211/129 X |
| 3,685,664 | 8/1972 | Kramer | 108/60 X |
| 3,847,489 | 11/1974 | Van Riper | 248/297.2 X |
| 3,960,273 | 6/1976 | Weston | 211/169 X |

FOREIGN PATENT DOCUMENTS

| | | | |
|---|---|---|---|
| 374975 | 5/1907 | France . | |
| 58789 | 11/1953 | France . | |
| 10520 | of 1910 | United Kingdom | 248/245 |

*Primary Examiner*—William E. Lyddane
*Assistant Examiner*—Peter A. Aschenbrenner
*Attorney, Agent, or Firm*—Pollock, Vande Sande & Priddy

[57] ABSTRACT

A display stand rotary gondola (10, 40); with shelves (22, 49); that are circular or in the form of sectors of circles. Each shelf comprises a support member (25, 54), adapted to slide up and down along a vertical riser (16, 43) and co-operating with a spline (18, 45) thereon by means of a fixing device (31, 34). Such stands are used in shops, stores and the like.

15 Claims, 7 Drawing Figures

DISPLAY STAND WITH SHELVES

TECHNICAL FIELD

The invention relates to a display stand with shelves of the type sometimes known as a rotary gondola. Such stands comprise pole or vertical riser supporting shelves that are, for example, circular, or in the form of sectors of a circle. The stands are used, in particular, in warehouses, shops, offices, store, and the like.

BACKGROUND OF THE INVENTION

Various display stands of this type are known, but they all suffer from the drawback of having relatively complex and rigid structures that are not readily transformable or modifiable. In particular, prior art stands do not enable a shelf to be positioned at any point along the pole or riser, nor do they enable a shelf loaded with articles or goods for display to be moved.

Preferred embodiments of the invention eliminate these drawbacks, by simplifying the structure of a display stand with shelves, and by facilitating assembly, disassembly and movement of the shelves, whether or not they are loaded.

DISCLOSURE OF THE INVENTION

The present invention provides a display stand with shelves, comprising a central vertical pole or riser and shelf elements which extend horizontally around the riser, wherein each shelf element is provided with a fixing device for fixing it to the riser, this fixing device enabling the shelf element both to be moved vertically along the riser in order to determine its height, and also to be locked in a desired position on the riser, independently of other shelf elements mounted on the riser.

Each shelf element may thus be moved vertically along the riser and be locked in any chosen position therealong.

In one embodiment of the invention, the shelf element fixing device comprises a guide slot adapted to receive a vertical spline projecting from the riser.

A first wall of the guide slot is preferably fixed, while the second wall thereof is movable towards and away from the first wall by means of a nut and bolt assembly.

Moving the shelf element along the riser, and locking it in the chosen position thereon are thus very easily done.

Advantageously, the stand may be provided with at least one vertical partition which extends radially from the riser along a radial edge of at least one shelf element, and which is supported by at least one shelf element.

BRIEF DESCRIPTION OF THE DRAWINGS

In the following description, given by way of example, reference is made to the accompanying drawings, in which.

BEST MODES FOR CARRYING OUT THE INVENTION

Figure 1:
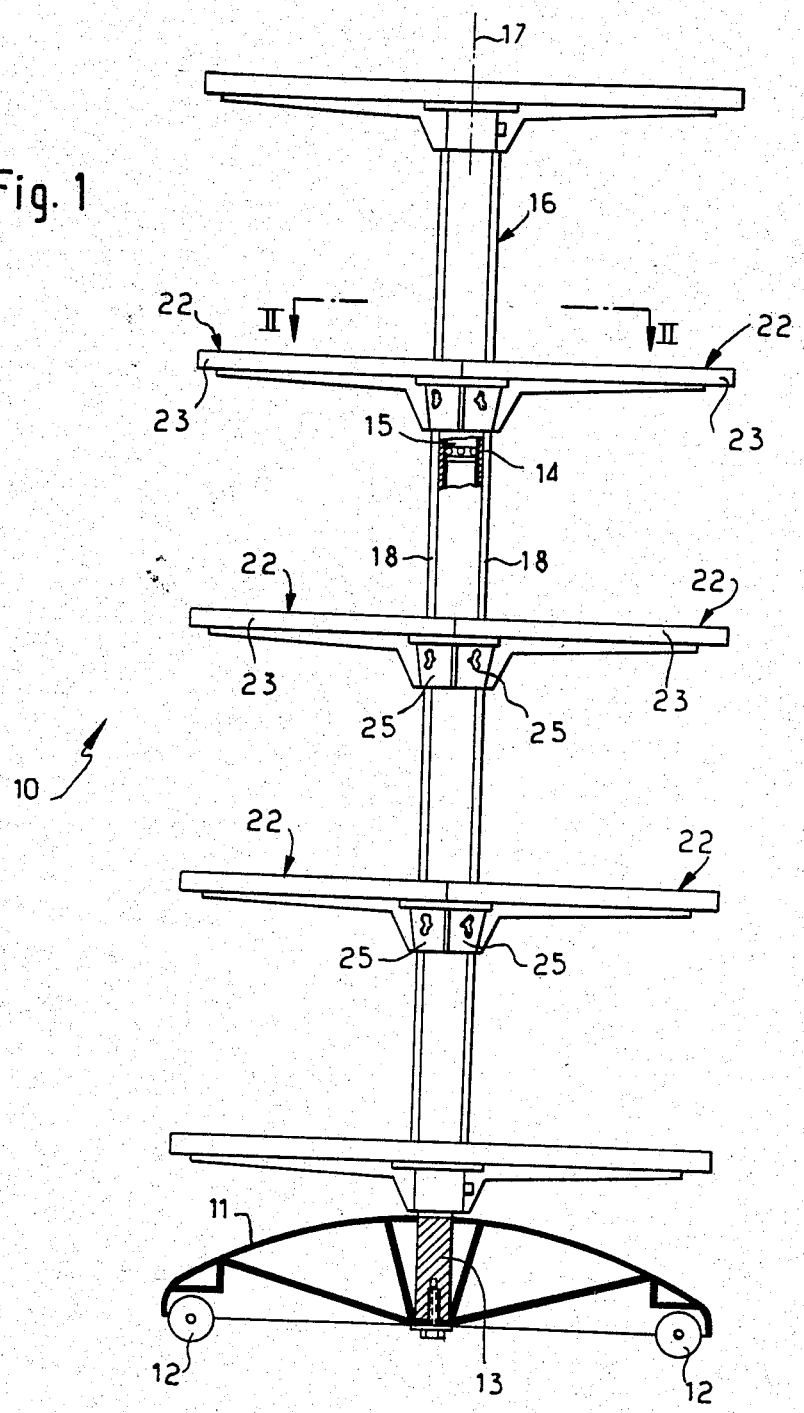
FIG. 1 is a diagrammatic elevation of a display stand in accordance with the invention.

In the embodiments shown in the drawings, the display stand with shelves in accordance with the invention are of the type sometimes known as rotary gondolas having horizontal shelves that are circular, or are in the form of sectors of a circle. Naturally, the shelves could have any other desired form, plane or otherwise.

Figure 2:
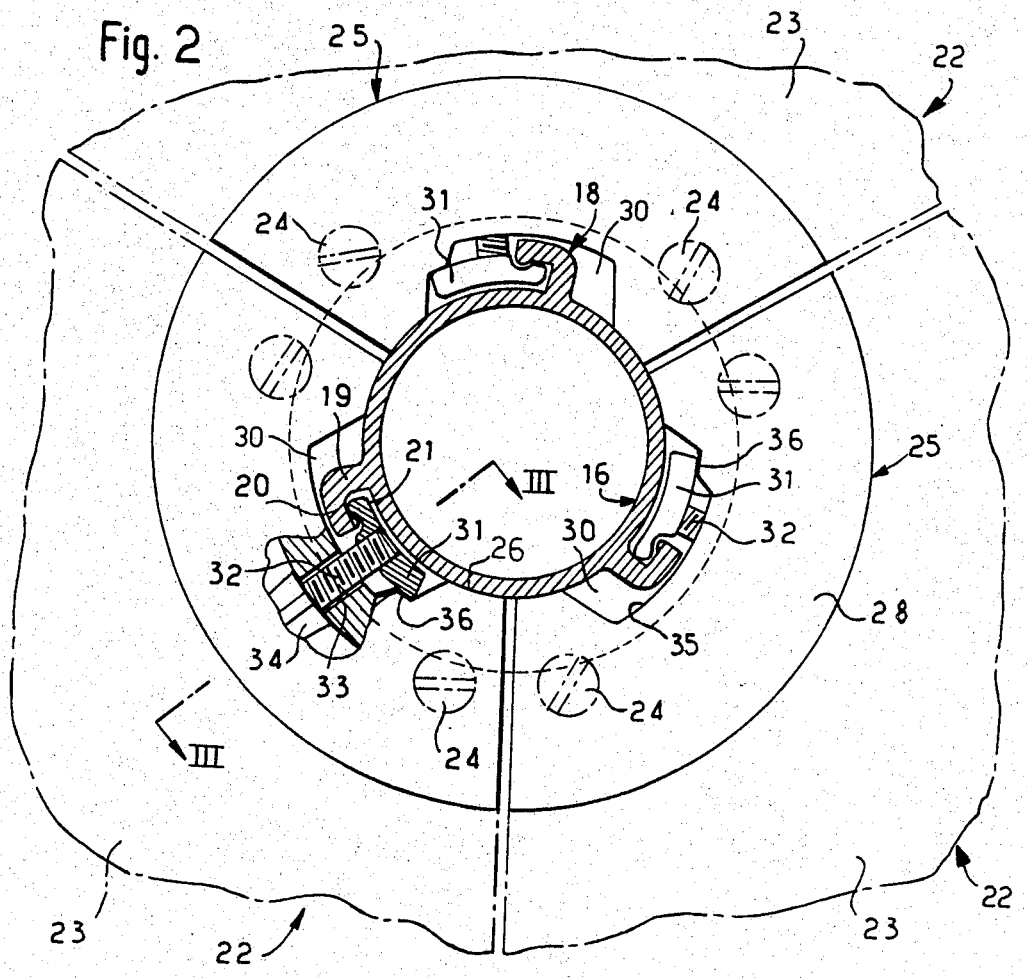
FIG. 2 is a cross section along line II—II of FIG. 1.
Figure 3:
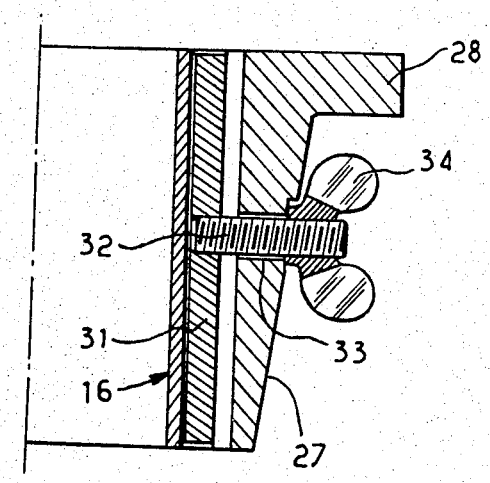
FIG. 3 is a cross section along line III—III of FIG. 2 showing the support member.

The stand 10 shown in FIGS. 1 to 3 comprises a foot or base 11 mounted on wheels 12 and supporting a central vertical pole 13 which is fastened to the base 11 by screws, for example. The pole 13 extends up the major part of the height of the stand 10 inside a tubular riser 16 of circular cross section. The upper upper end of the pole 13 is provided with an end stop 14 having ball-bearings or the like supporting a plate or spacer 15 located inside the riser 16. The tubular riser 16 is thus mounted to rotate about is vertical axis 17 which is coaxial with the vertical axis of the central pole 13.

The outer surface of the riser 16 has outwardly projecting vertical splines 18, and these are three in number in the embodiment shown. Each spline 18 is L-shaped in horizontal cross section, comprising a first portion 19 extending perpendicularly or radially from the outer surface of the riser 16, and a portion 20 which is perpendicular to the first, extending parallel to the outer peripheral surface of the riser 16 and defining a groove 21 in conjunction therewith.

The shelves of the stand 10 are substantially plane and are made from shelf elements 22 in the form of sectors of a circle subtending an angle of 120° at the center. Thus, when three shelf elements 22 are disposed at the same level about the central riser 16, they make up a substantially continuous circular shelf (FIGS. 1 and 2).

Each shelf element 22 is constituted by a substantially plane plate 23 fixed by screws 24 to a support member 25 which extends over 120° around the central riser 16 and whose inner surface 26 is in the shape of a cylinder of circular cross section, while its outer surface 27 is in the shape of a truncated cone. The support member 25 has an annular horizontal flange 28 at its upper end to which the plate 23 is screwed.

The cylindrical internal surface 26 of each member 25 has a longitudinal groove 30 extending along the entire height of the member and having a width that is much larger than the width of the splines 18 of the central riser 16. The depth of the groove 30 is also larger, but only slightly, than the corresponding dimension of the splines 18 of the riser 16.

A guide slot with an movable wall is defined by the fixed bottom wall of the groove 30 acting in conjunction with a curved or cylindrical plate or movable wall 31 housed in the groove 30. A threaded rod 32 extends substantially radially, having one end made fast to the plate 31 and passing through a hole 33 in the wall of the support member 25. A wing nut 34 is screwed on the free end of the threaded rod 32 to bring the plate 31 nearer to the bottom 35 of the groove 30. The bottom 35 may have a stop or projection 36 against which one side of the plate 31 bears, while its opposite side bears against the portion 20 of a spline 18 of the riser 16, inside the above-mentioned groove 21.

The shelf element fixing device is used as follows: with the wing nut 34 unscrewed, the support member 25 is brought against the vertical riser 16 in such a manner that one of the splines 18 of the riser fits into the groove 30 of the member 25. The member 25 is then turned about the riser 16 so that the side or vertical edge of the plate 31 fits into the groove 21 formed by the spline 18. By screwing the nut 34 onto the end of the threaded rod 32, the edge of the plate 31 is tightened against the portion 20 of the spline 18, and simultaneously the inner peripheral surface 26 of the member 25 is brought to bear against the outer peripheral surface of the riser 16. The member 25 is thus locked in position and can carry relatively heavy loads.

Three support members 25 may be fixed to the riser 16 at the same horizontal level so that the plates they support make up a circular shelf. If a shelf element 22 is to be moved, it is necessary only to loosen the corresponding nut 34 and slide the shelf element 22 (and hence its support member 25) vertically along the riser 16 before turning it slightly about the riser to disengage the portion 20 of the spline 18 from the guide slot formed by the plate 31 and the bottom 35 of the corresponding groove 30.

To improve fixing the support member to the riser 16, the co-operating edges of the plate 31 and the portion 20 of the spline may have rounded lips or projections of complementary shape, as shown.

The shelf elements 22 in the form of sectors of a circle may be grouped in threes to make up circular shelves, as shown in the drawings, or they may be disposed helically about the vertical riser 16, etc.

In the example shown in FIG. 1, the shelves at the ends of the riser 16 are single piece circular shelves, but they could naturally be likewise made up from three shelf elements 22 in the form of sectors of a circle.

The support members 25 may be used for fixing substantially plane plates 23 as shown in the drawings, or they may be used for fixing baskets, etc. The support members 25 may also be used to fix vertically extending radial partitions etc.

Figure 4:
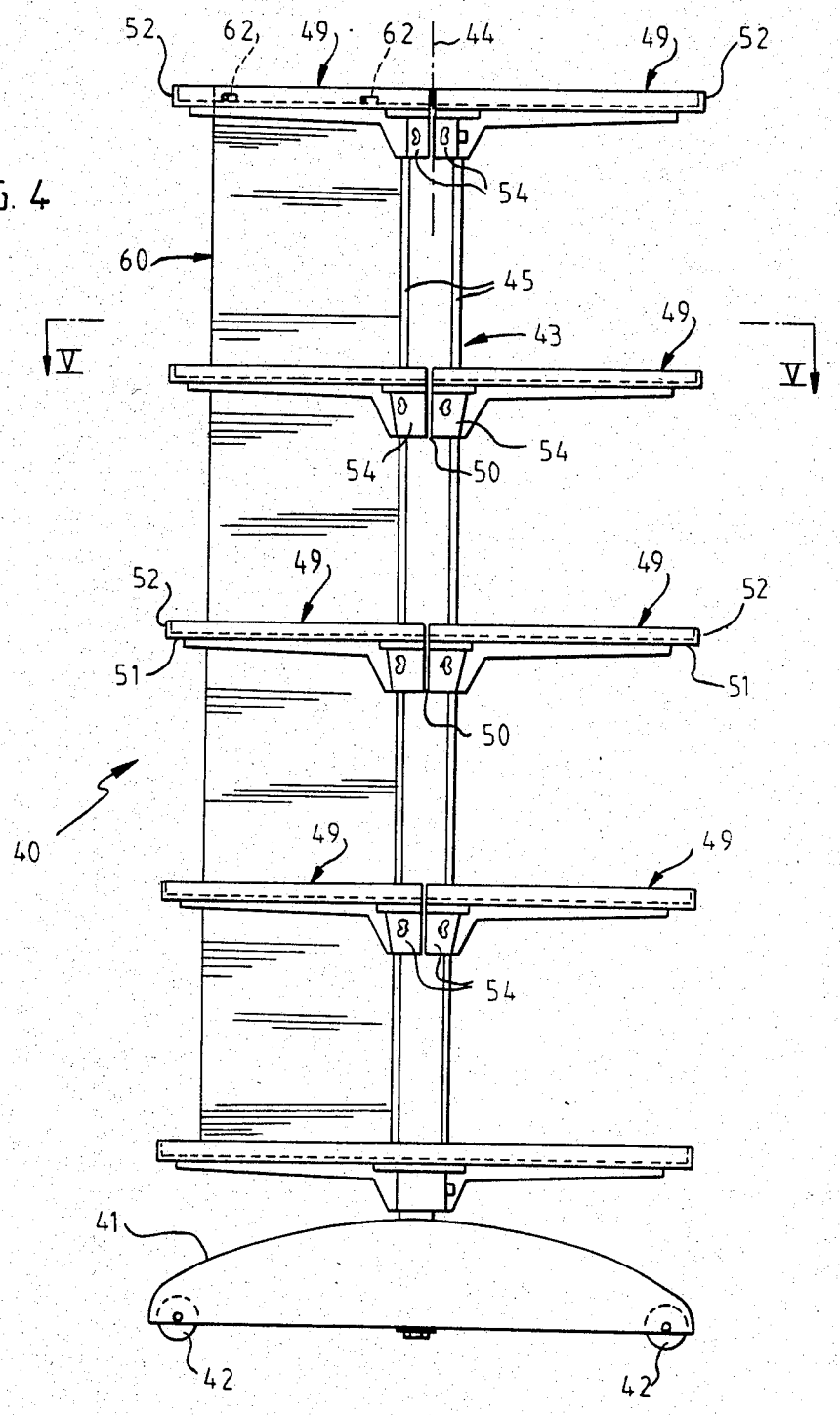
FIG. 4 is an elevation of the display stand fitted with a vertical partition.

FIG. 4 is a diagrammatic view of a shelved display stand in accordance with the invention which includes a vertical partition extending radially from the central vertical riser of the stand.

Figure 5:
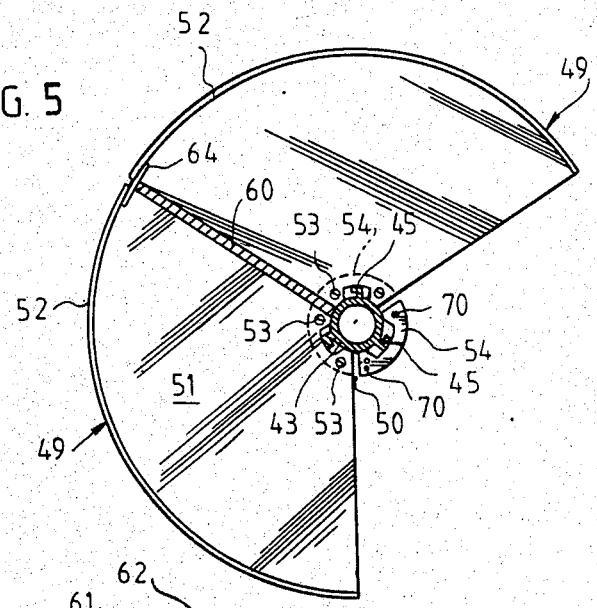
FIG. 5 is a diagrammatic cross section along a line V—V of FIG. 4.

The stand 40 includes a foot or base 41 mounted on wheels 42 and supporting a central vertical riser 43 which is mounted to rotate about its vertical axis 44. As described above, the riser 43 has outwardly projecting vertical splines 45, which are three in number in the embodiment shown. Each spline is L-shaped in horizontal cross section (FIG. 5) and comprises a first branch which extends radially from the riser 43 to meet a second branch which is substantially perpendicular to the first and extends parallel to the outer peripheral surface of the riser 43, defining a groove in conjunction therewith.

The shelves 52 of the stand 40 are made up from shelf elements 49 that are in the form of sectors of a circle subtending an angle of about 120° at the center. Thus, when three shelf elements 49 are placed around the central riser 43 in the same horizontal plane, they make up a substantially continuous circular shelf, while remaining separated from each other by spaces or gaps 50.

Each shelf element 49 is constituted by a substantially plane plate 51 with an outer rim 52. The plate is fixed by screws 53 to a support member 54 which extends over about 120° around the vertical riser 43 and which is substantially identical to the member 25 described above.

The inner cylindrical surface of each support member 54 has a longitudinal groove extending over its entire height and suitable for loosely receiving the spline 45 of the central riser 43. A plate similar to plate 31 is housed in the groove for the purpose of being tightened against one of the branches of the spline 45 by means of a threaded rod and nut arrangement as described above.

As indicated above, this arrangement enables each shelf element 49 to be moved vertically along the central riser 43, and to be connected thereto and disconnected therefrom independently of other shelf elements on the stand.

Figure 6:
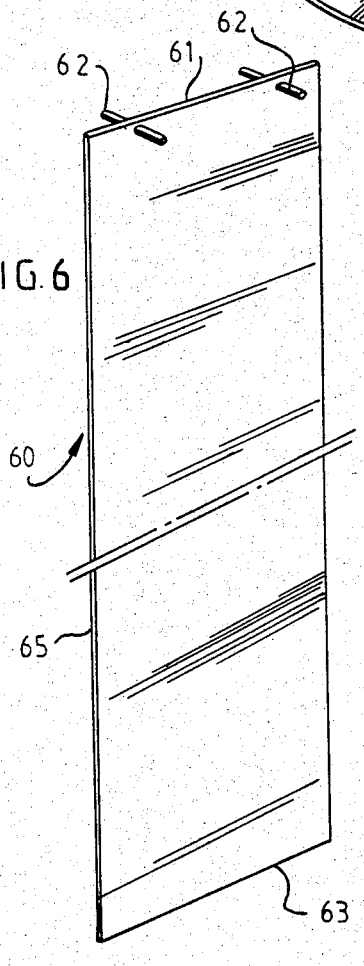
FIG. 6 is a diagrammatic perspective view of a first partition for the stand of FIG. 4.

The stand 40 may be provided with one or more vertical partitions extending radially from the central riser 43. In a first embodiment, a radial partition 60 (shown in detail in FIG. 6) may be disposed in the space or gap 50 in between two adjacent shelf elements 49. In the example shown, the partition 60 is a plane rectangular plate of plastic material which extends substantially over the entire height of the stand, as shown in FIG. 4, and which may be transparent, semi-transparent, dark tinted, or opaque.

Near to its top horizontal edge 61, the plate 60 has one or more horizontal fingers 62 disposed perpendicularly to the plate and projecting from both sides thereof. The fingers 62 may be lengths or cylindrical dowel inserted through holes in the plate 60 and fixed by any suitable means, for example by welding or gluing. The fingers 62 may also be removably mounted in the holes through the plate. The fingers are long enough to rest on both of the elements 49 of the top shelf between which the plate is disposed, whereby the plate is suspended from the said shelf elements. The plate 60 also extends between pairs of elements 49 of the lower shelves that are vertically aligned with the pair of elements 49 of the top self, but it is not fixed to the lower shelf elements. The bottom horizontal edge 63 of the plate may rest on the bottom shelf of the stand, in which case the bottom shelf may either be in the form of a continuous shelf, or it may be made up by juxtaposing elements 49 in the form of sectors of a circle which meet at their edges.

Advantageously, the rims 52 of the shelf elements 49 between which the partition 60 is disposed are connected to one another by additional parts 64 which form stops for the outside vertical edge 65 of the partition 60. The parts 64 may be fixed by any suitable means to the rims 52, and may have the form of a spring clip riders that fit elastically over the rims 52 to be joined. The parts 64 could alternatively be simple lengths of strip placed against the rims 52 and bridging the spaces and gaps 50.

In the example shown, the vertical extent of the plate 60 is substantially equal to the distance between the top and bottom shelves of the stand, while its radial or horizontal extent is substantially equal to that of the shelf elements. Naturally these dimensions of the partition 60 could be of some smaller size.

Figure 7:
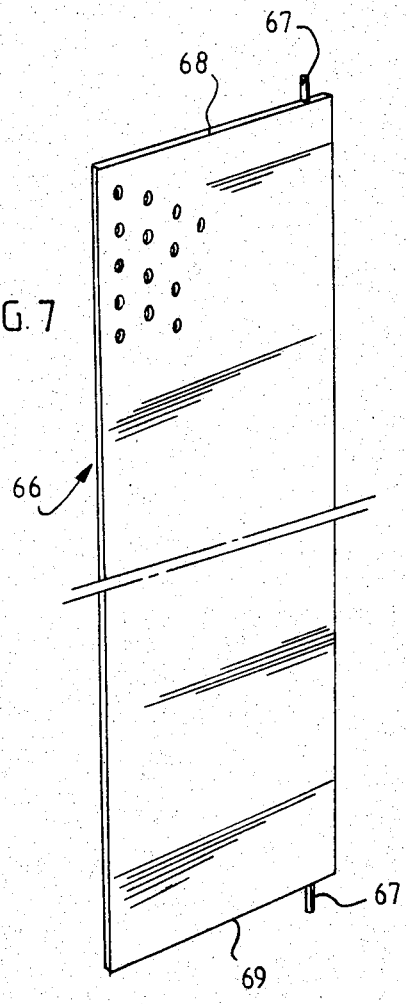
FIG. 7 is a diagrammatic perspective view of a second partition for the stand of FIG. 4.

FIG. 7 shows another embodiment of a partition. This partition 66 is constituted by a substantially plane rectangular plate, e.g. of perforated metal sheet, with two vertically aligned pins 67 projecting respectively from its top horizontal edge 68 and from its bottom horizontal edge 69. The vertical pins 67 provide an axis about which the partition 66 is pivoted, and they are suitable to be received in appropriate holes or other housings 70 formed in the shelf elements 49 or in their support members 54. Removable stops may be provided to restrict the angle through which the partition 66 can pivot, e.g. by providing pegs (not shown) to be inserted in holes in the shelf elements 49 or their support members 54.

Naturally many modifications may be made to the embodiments shown in FIGS. 4 to 7. For example, the fingers 62 of the partition 60 shown in FIG. 6 could be replaced by hooks or the like, which would enable the said partition to be suspended from a single shelf element 49.

I claim:

1. A display stand, comprising a central vertical riser having on its external face at least one outwardly projecting vertical spline which is L-shaped in horizontal cross-section; a plurality of shelf elements situated about said vertical riser, each shelf element being fixed to a support member, said support member comprising a vertical guide slot adapted to receive said vertical spline and an inner surface positioned to engage said external face of said riser when said spline is received in said guide slot; one side of said L-shaped cross-sectional vertical spline projecting radially from said riser and the other side extending perpendicularly thereto and adapted to be received in said guide slot, said guide slot comprising a first, fixed wall, a second movable wall and means for moving said second wall toward and away from said first wall to grip and release said at least one spline; said at least one spline extending between said first and second walls; said inner surface of said support member being pressed against said external face when said at least one spline is gripped between said first and second walls.

2. A display stand according to claim 1, wherein said support member comprises a vertical groove for receiving said at least one spline, said groove having a width and depth larger than the corresponding dimensions of said at least one spline.

3. A display stand according to claim 1, wherein said means for moving comprises a nut and bolt assembly having a threaded rod passing through said fixed wall, with one end fixed to said movable wall and with a nut screwed onto the free end thereof.

4. A display stand according to claim 3, wherein said nut is a wing nut.

5. A display stand according to claim 1, wherein said other side of said spline ends in a rounded portion or lip adapted to cooperate with a complementary rounded portion or lip on said movable wall.

6. A display stand according to claim 1, wherein each shelf element comprising a plate in the form of a sector of a circle fixed to said support member.

7. A display stand according to claim 1, wherein said riser is in the form of a cylindrical tube of circular section, and has three outwardly projecting vertical splines regularly spaced about its vertical axis.

8. A display stand according to claim 1, wherein said riser is rotatably mounted about its vertical axis and is supported by a wheeled foot.

9. A display stand according to claim 1, wherein said stand comprises at least one vertical partition which extends radially from said riser along a radial edge of at least one shelf element, and which is supported by at least one shelf element.

10. A display stand according to claim 9, wherein two shelf elements are fixed to the riser substantially in the same horizontal plane and are separated by a space or gap, and wherein said partition is disposed in said space or gap between said two shelf elements.

11. A display stand according to claim 10, wherein said partition comprises a top horizontal edge having at least one projection suitable for engaging a shelf element to support said partition.

12. A display stand according to claim 11, wherein said at least one projection is constituted by a finger extending perpendicularly to said partition on either side thereof to rest on the adjacent shelf elements, thereby providing support for said partition.

13. A display stand according to claim 10, wherein the peripheral edges of said pair of adjacent shelf elements are connected together by an additional part which bridges the said gap between said pair of adjacent shelf elements and which acts as a stop for the vertical edge of said partition.

14. A display stand according to claim 9, wherein said partition is adapted to be pivotally mounted about a vertical axis between two shelf elements that are vertically aligned on said riser, by means of two vertical pins which project respectively from the top edge and from the bottom edge of said partition, and which are received in appropriate holes or housings in said shelf elements.

15. A display stand according to claim 9, wherein said partition is a plane plate made of plastic or perforated metal sheet.

* * * * *